US006964576B2

(12) United States Patent
Crutchfield

(10) Patent No.: US 6,964,576 B2
(45) Date of Patent: Nov. 15, 2005

(54) ENABLING COMPONENTS TO BE REMOVED WITHOUT HOT SWAP CIRCUITRY

(75) Inventor: Randolph E. Crutchfield, Scottsdale, AZ (US)

(73) Assignee: Intel Corporation, Santa Clara, CA (US)

( * ) Notice: Subject to any disclaimer, the term of this patent is extended or adjusted under 35 U.S.C. 154(b) by 697 days.

(21) Appl. No.: 09/802,032

(22) Filed: Mar. 8, 2001

(65) Prior Publication Data

US 2004/0209501 A1 Oct. 21, 2004

(51) Int. Cl.[7] ..... H01R 13/44
(52) U.S. Cl. ..... 439/142; 439/911; 455/575.1; 375/222
(58) Field of Search ..... 439/142, 138, 439/135, 299, 300, 911, 144; 361/683, 685, 361/724–727; 455/575.1; 375/222; 708/109; 710/302

(56) References Cited

U.S. PATENT DOCUMENTS 3,147,056 A * 9/1964 Mendelson ..... 439/145
3,768,064 A * 10/1973 Pabich ..... 439/370
4,091,246 A * 5/1978 Donofrio et al. ..... 200/50.28
5,050,211 A * 9/1991 Dortu et al. ..... 379/438
5,124,506 A * 6/1992 Briggs et al. ..... 174/67
5,174,773 A * 12/1992 Jones ..... 439/147
5,556,289 A * 9/1996 Holbrook, Jr. ..... 439/135
5,628,055 A * 5/1997 Stein ..... 455/575.1
5,738,536 A * 4/1998 Ohgami et al. ..... 439/142
5,761,045 A * 6/1998 Olson et al. ..... 361/726
5,841,631 A * 11/1998 Shin et al. ..... 361/684
6,267,608 B1 * 7/2001 Yagi ..... 439/142
6,301,126 B1 * 10/2001 Smith ..... 361/826
6,490,153 B1 * 12/2002 Casebolt et al. ..... 361/685
6,535,390 B1 * 3/2003 Lo ..... 361/726
6,678,162 B2 * 1/2004 Chewning ..... 361/726
6,757,160 B2 * 6/2004 Moore et al. ..... 361/683

* cited by examiner

*Primary Examiner*—Gary Paumen
(74) *Attorney, Agent, or Firm*—Trop, Pruner & Hu, P.C.

(57) ABSTRACT

A processor-based system may function without expensive hot swap circuitry by preventing component swapping with power applied to the system. The access to a swappable component may be arranged so that the component can not be removed with a power carrying cable plugged into the system.

26 Claims, 2 Drawing Sheets

ENABLING COMPONENTS TO BE REMOVED WITHOUT HOT SWAP CIRCUITRY

BACKGROUND

This invention relates generally to processor-based systems and particularly to such systems whose components may be swapped.

In a variety of circumstances, it may be desirable to swap or exchange components such as external memory cards in a processor-based systems. In some systems, different memory cards may be used to store different information or programs. In other cases, it may desirable to swap memory cards to repair or upgrade those memory cards.

Many processor-based systems include circuitry to enable hot swapping. With hot swapping, components such as memory cards may be removed while power is still applied to the processor-based system. In other words, the system does not need to go through a configuration cycle associated with the booting process in order to recognize newly inserted cards or other components.

While enabling hot swapping has many advantages, it also necessarily involves additional costs. Circuitry needs to be added to buffer the signals while the swapped component powers up. Moreover, circuitry needs to be provided to ensure that the component smoothly attaches to the rest of the processor-based system.

The extra expense of hot swap circuitry may be eliminated by making sure that the system is powered down when the component is swapped. For example, it may be necessary to ensure that the battery is removed from the processor-based system before swapping a component. The battery may be physically located in front of a swappable memory card. Then, the battery must be removed to swap the card.

The need for such an approach arises because many computer users are now fully apprised of hot swapping. They may be unaware or may have forgotten that a particular system does not support hot swapping. While in the past it may have been assumed that hot swapping was not possible, with the proliferation of systems that incorporate hot swapping, users may be prone to simply hot swap memory cards in systems that do not include this functionality.

The situation is made even more complicated in modern processor-based systems because the sources of power may be diverse. Power may be supplied, for example in portable processor-based systems, by both batteries and power carrying cables connected to the system. Examples of power carrying cables include buses that supply power such as the Universal Serial Bus (USB), and the Apple Desktop Bus (ADB) to mention two examples.

Thus, the user must appreciate that prior to swapping the memory card, not only must the battery be removed but also any power carrying cables must be removed. This adds a level of complexity that may be problematic for some users of processor-based systems.

Ideally, processor-based systems may operate like conventional consumer appliances. Many processor-based systems have the look and feel of conventional consumer-based appliances. Examples of appliance-like processor-based systems include digital audio players and digital cameras. Users may not appreciate that in fact the system is a processor-based system because it acts and feels like an appliance.

To require that the user understand the operation of the system sufficiently to know that, to replace the memory card, powered cables must be removed, reduces the appliance-like operation of the system. Moreover, the system may be damaged or may fail to operate correctly when users fail to take the required steps before replacing memory cards.

Thus, there is a need for a better way to avoid hot swapping circuitry in processor-based systems while still allowing components to be replaced.

DETAILED DESCRIPTION

Figure 1:
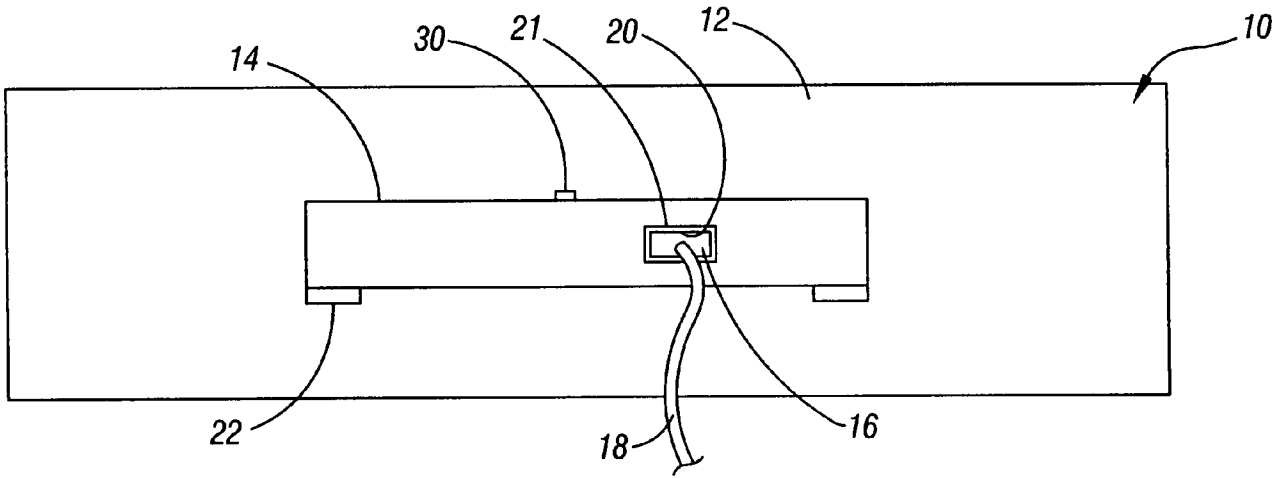
FIG. 1 is a front elevational view of a processor-based system in accordance with one embodiment of the present invention with an access door closed.

Referring to FIG. 1, a processor-based system 10 may be a battery powered processor-based system in one embodiment. In such case, the system 10 may be a laptop computer, a personal digital assistant, a digital audio player, a digital camera or a web tablet to mention a few examples. In these and other processor-based systems 10, it may be desirable to avoid the expense of providing hot swapping circuitry. The problem then arises as to how to enable the removal of components such as external memory cards without hot swapping circuitry when power carrying cables (perhaps as well as batteries) must be deactivated before removing such components.

The processor-based system 10 may include a surface 12 such as a back surface of the system enclosure. The surface 12 may include an access door 14. In the embodiment shown in FIG. 1, the access door 14 is a bottom pivoting access door that pivots on hinges 22. However, in other embodiments of the present invention, the manner of door opening is subject to complete variability. The door 14 may be latched closed by a latch 30 along its upper edge in one embodiment.

Passing through the door 14 is an access port 21 to enable a power carrying cable 18 and its plug 16 to plug into a connector such as a jack 20 in the system 10. Thus, the power carrying cable 18 and its plug 16 plug through the door 14 into the processor-based system 10.

Examples of power carrying cables 18 include USB and ADB buses as two examples. In these cases, a power supply is effectively made available over the cable 18. Thus, power may be available even when a battery (or other power source) is removed from the processor-based system 10. This may create problems if memory cards or other components are removed from the system 10 while power is still available through the cable 18.

Because of the arrangement of the cable 18 passing through the door 14, and particularly the interaction between the plug 16 and the door 14, it is not possible to open the access door 14 with the cable 18 plugged into the jack 20. Thus, by positioning a swappable component (such as a memory card) behind the door 14, a user can only remove the component after having first removed the cable 18 from the system 10.

Figure 2:
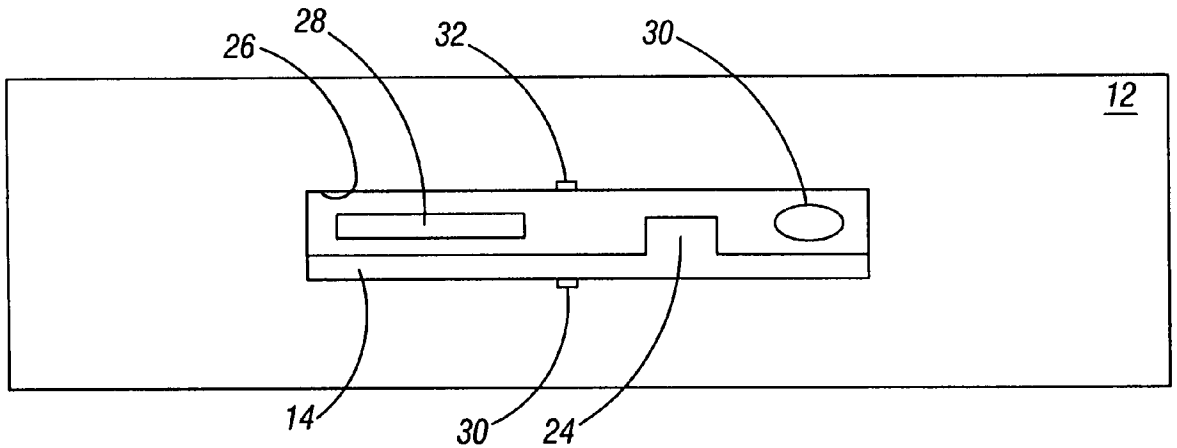
FIG. 2 is a front elevational view corresponding to FIG. 1 with the access door open.

Referring to FIG. 2, the door 14 is shown in its open position, rotated ninety degrees in one embodiment of the present invention from the position shown in FIG. 1. The hinges 22 may hold the door open at the transverse or ninety degree position in one embodiment. Of course, prior to opening the door 14, it was necessary to remove the cable 18 and its plug 16 from the jack 20 thereby freeing the door 14 to swing outwardly open. In one embodiment, the latch 30 is released from a catch 32 on the surface 12 to enable the door 14 to pivot open. A wide variety of latch/catch systems or other securement means may be provided which releasably latch the door 14 in the closed position shown in FIG. 1.

With the door 14 open, an access port 26 is revealed that provides access to a component 28 such as an external memory card. In addition, a battery 30 is similarly accessible through the port 26 in one embodiment. The battery 30 may be positioned so that it is impossible to remove the component 28 from its plug-in slot without first removing the battery 30. Thus, removal of the component 28 is blocked, firstly, by the door 14 which requires removal of the power carrying cable 18, and, secondly, by the positioning of the battery 30 with respect to the component 28 which requires battery removal before removal of the component 28. As a result, the user can not plug in or remove the component 28 without removing the power carrying cable 18 and, in some embodiments, the battery 30. This ensures that the component 28 can not be inadvertently hot swapped and may eliminate the need for hot swap circuitry in the system 10 in some cases.

Figure 3:
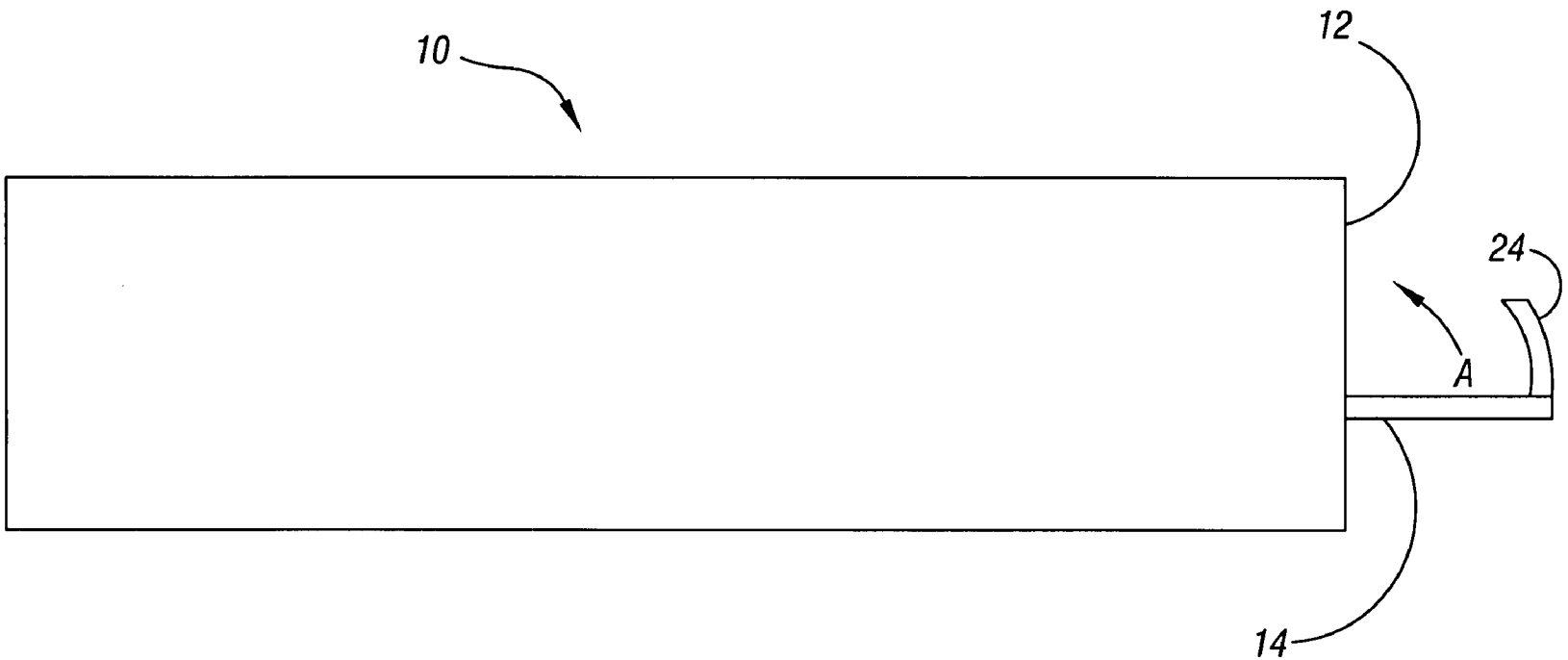
FIG. 3 is an enlarged, side elevational view of the embodiment shown in FIG. 2.

Of course, the possibility remains that the user may attempt to replug in the cable 18 with the door 14 open. Thus, an obstruction 24 may be provided on the inside surface of the door 24, blocking access to the jack 20 when the door 14 is open. As shown in FIG. 3, the obstruction 24 may be a curved surface extending away from the inside surface of the door 14, blocking access to the jack 20.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

providing a connector for a power carrying cable to a processor-based device;

providing an openable access door to access a component and said connector;

blocking access to said component when power is coupled to said connector; and providing an extension on said door that blocks access by said cable to said connector when said door is open and a battery is positioned so that said component can not be removed unless said battery is also removed.

2. The method of claim 1 including blocking access to an external memory card when the cable is coupled to the connector.

3. The method of claim 1 including blocking access to the component by causing the cable to extend through a door that is openable to access the component.

4. The method of claim 1 including causing said cable to pass through a component access door so that that the door may not be opened with the cable in place.

5. The method of claim 1 including blocking access to said connector when said door is open.

6. The method of claim 1 including preventing said door from opening when said cable is coupled to the connector.

7. The method of claim 6 including causing the cable to pass through said door when said door is closed.

8. A processor-based system comprising:

a structure associated with said component, said structure includes a housing for said processor-based system, said housing including a surface with a battery access door, said door arranged so that said door may not be opened without physically disconnecting the cable for the power carrying bus from the system, and a battery is positioned so that said component can not be removed unless said battery is also removed.

9. The system of claim 8 wherein said cable extends through said door.

10. The system of claim 9 wherein said cable plugs into a connector through said door.

11. The system of claim 10 wherein said door is pivotable and said door is blocked from pivoting open with said cable connected to said connector.

12. The system of claim 11 wherein said door includes an obstruction which blocks access to said connector when said door is open.

13. The system of claim 12 wherein said obstruction is a curved surface attached to an inside surface of said door.

14. The system of claim 8 wherein said component is an external memory card.

15. A processor-based system comprising:

a housing including a swappable component;

a door on said housing providing access to said swappable component;

a connector for a power carrying bus cable, said connector accessible by the cable through said door; and an obstruction on said door which obstruction blocks access to said connector when said door is open.

16. The system of claim 15 wherein said door is pivotable and said door is blocked from pivoting open with said cable connected to said connector.

17. The system of claim 15 wherein said obstruction is a curved surface attached to an inside surface of said door.

18. The system of claim 16 wherein said door provides access to a battery.

19. The system of claim 18 wherein said battery is positioned so that said component can not be removed unless said battery is also removed.

20. The system of claim 15 wherein said component is an external memory card.

21. The system of claim 20 wherein said system is a digital audio player.

22. The system of claim 20 wherein said system is a digital camera.

23. The system of claim 15 wherein said connector is a Universal Serial Bus jack.

24. A processor-based system comprising:

a housing including a swappable component;

a door on said housing providing access to said swappable component and a battery, said battery positioned so that said component cannot be removed unless said battery is also removed; and a connector for a power carrying bus cable, said connector accessible by the cable through the door.

25. The system of claim 24 wherein said door includes an obstruction which blocks access to said connector once the door is open.

26. The system of claim 24 wherein said component is an external memory card.

* * * * *